US005615586A

United States Patent [19]

Phillips et al.

[11] Patent Number: 5,615,586

[45] Date of Patent: Apr. 1, 1997

[54] CAM DEVICE

[75] Inventors: George E. Phillips, Oshkosh; Eric B. Hudson, Hilbert, both of Wis.

[73] Assignee: Brunswick Corporation, Lake Forest, Ill.

[21] Appl. No.: 479,117

[22] Filed: Jun. 7, 1995

[51] Int. Cl.[6] ..... F01L 1/04

[52] U.S. Cl. ..... 74/567; 123/90.31; 123/90.6

[58] Field of Search ..... 74/116, 122, 125, 74/567, 569; 123/90.31, 90.48, 90.51, 90.6

[56] References Cited

U.S. PATENT DOCUMENTS

| | | | |
|---|---|---|---|
| 1,312,577 | 8/1919 | Redrup | 123/90.48 |
| 2,081,390 | 5/1937 | Trapp | 123/90.48 |
| 3,045,503 | 7/1962 | Kiessling | 74/569 |
| 3,339,670 | 9/1967 | McGrew, Jr. et al. | 74/569 |
| 3,886,805 | 6/1975 | Koderman | 123/90.31 |
| 4,595,556 | 6/1986 | Umeha et al. | 74/567 |
| 5,215,164 | 6/1993 | Shibata | 184/6.13 |

FOREIGN PATENT DOCUMENTS

| | | | |
|---|---|---|---|
| 1234889 | 6/1971 | United Kingdom | F04C 23/00 |

*Primary Examiner*—Charles A. Marmor
*Assistant Examiner*—Mary Ann Battista
*Attorney, Agent, or Firm*—Wood, Phillips, VanSanten, Clark & Mortimer

[57] ABSTRACT

In internal combustion engine (10) having a power shaft (12) mounted in an engine block (11) for rotation about a power shaft axis (X), a valve arrangement (20) for controlling intake to and exhaust from a combustion chamber (20), and a cam device (22) for actuating the valve arrangement (20); the cam device (22) includes a ring cam (24) having a generally ring-shaped body, with the body having an inner peripheral surface (35) and an outer peripheral surface (26). The ring cam (24) is mounted to the engine block (11) for rotation about a cam axis (Y) displaced from the power shaft axis (X). A cam surface (32) or (34) is provided on the outer peripheral surface (26) for actuating the valve arrangement (20) as the ring cam (24) is rotated about the cam axis (Y). A gear (38) is operably engaged with the power shaft (12) and nested inside the inner peripheral surface (35) for driving the ring cam (24). A gear (36) is provided on the inner peripheral surface (35) for being driven by the gear (38) to rotate the ring cam (24) about the cam axis (Y). A pair of cam followers (28) and (30) are received in an elongated aperture (66) having a non-circular cross-section formed in the engine (10), and are driving by the for sliding, linear motion relative to each other and the engine block (11) by the ring cam (24).

24 Claims, 3 Drawing Sheets

CAM DEVICE

FIELD OF THE INVENTION

This invention generally relates to the art of engines and, more particularly, cams used for actuating the valve arrangement of an internal combustion engine.

BACKGROUND OF THE INVENTION

Use of valves to control intake to and exhaust from a combustion chamber in an internal combustion engine has long been known. It is common for the valves to be actuated by a cam device which times the opening and closing of the valves with respect to the cycle of the engine. These cams are typically driven by the power shaft of the engine through a drive train which times the cam relative to the rotational position of the power shaft and thereby with respect to the engine cycle. The location of the cam with respect to the power shaft and the valves can dictate the design of the valves and the cam drive train, Thus, in the design of an internal combustion engine, the location of the cam relative to the valve arrangement and the power shaft is an important design consideration. The relative complexity, the compactness, the number of components, and the packaging into the engine of both the valve arrangement and the cam drive train are all affected by the relative location of the cam. In turn, these design parameters for the valve arrangement and the cam drive train directly affect the compactness and reliability, which are often high priorities in internal combustion engines. Additionally, portability is often a high priority for small engines and, again, will be directly affected by the above-mentioned design parameters.

One common cam arrangement is a straddle-mounted cam shaft having a drive gear or sprocket rotationally fixed to one end. The drive gear or sprocket is driven by the power shaft through a gear train, timing chain, or timing belt. While such cam shafts are capable of satisfactory performance, they do not necessarily lend themselves to compact and/or high reliability engine design. For example, the length of the cam shaft and the straddle-mounting can make the packaging of the cam shaft within the engine problematic. Often, the packaging of such cam shafts dictates that the cam shaft be located remote from the power shaft. Such remote location can increase the complexity of the cam shaft drive train, thereby decreasing its reliability. If a gear train is used, several gears may be required to span the distance between the power shaft and the remotely located cam shaft. Reliability can be affected by the build-up of inaccuracies caused by the backlash at each mesh point in the gear train. Further, each gear represents a potential single point failure in the drive train. Similarly, if a timing chain is used, a relatively long chain may be used to span the distance between the power shaft and the remotely located can shaft. Again, each link represents an additional inaccuracy, as well as an additional single point failure in the drive train.

A unique cam arrangement has been used in radial aircraft engines to satisfy the special requirements presented by the radial orientation of the engine cylinders. Such engines have employed a ring cam driven by the engine power shaft through a planetary gear train consisting of a sun gear mounted on the power shaft, a plurality of planet gears mating with the sun gear, and a ring gear mating with the planet gears. This arrangement is employed in radial aircraft engines because it is desirable to mount the cam coaxially with the crankshaft so that the cam is equidistant from the valve arrangements associated with each of the cylinder heads.

While such cam arrangements are capable of satisfactory performance in radial aircraft engines, they do not necessarily lend themselves to compact and reliable engine design. For example, the use of the planetary gear train requires that the ring cam be mounted coaxial with the power shaft. This coaxial configuration can put severe limits on the sizing of the cam and the associated planetary gear train, as well as the location, type, and orientation of the valve arrangement. Further, the use of planet gears can reduce the reliability of the engine due to the error introduced at the mesh points of the planet gears and the potential single-point failure represented by the planetary gear set. Additionally, the use of planet gears adds additional weight and complexity to the engine and takes up space within the engine which potentially could be utilized for other engine components, thereby directly affecting the compactness and portability of the engine.

Thus, it can be seen that there is a need for a compact cam design which can be incorporated within an internal combustion engine minimizing the number of dedicated components and allowing for high reliability of the engine.

SUMMARY OF THE INVENTION

It is a principal object of the invention to provide a new and approved cam configuration. More specifically, it is an object to provide a cam configuration which lends itself to compact engine design while providing high reliability for the engine. It is a further object of the invention to increase the portability of the engine while decreasing the cost of the engine by minimizing the number of dedicated components required for the cam configuration. It is yet a further object of the invention to provide a cam configuration which lends itself to manufacture from powdered metal, with no requirement for finish grinding of the cam profile.

In the preferred embodiment, the invention is incorporated in an internal combustion engine having an engine block, a power shaft mounted in the engine block for rotation about a power shaft axis, a combustion chamber, a valve arrangement for controlling intake to and exhaust from the combustion chamber, and a cam device for actuating the valve arrangement. The cam device includes a ring cam having a generally ring-shaped body, with the body having an inner peripheral surface and an outer peripheral surface. The ring cam is mounted to the engine block for rotation about a cam axis displaced from the power shaft axis. A cam surface is provided on the outer peripheral surface of the body for actuating the valve arrangement as the ring cam is rotated about the cam axis. A drive means is operably engaged with the power shaft and nested inside the inner peripheral surface of the ring cam for driving the ring cam. The drive means rotates at a drive speed. A driven means is provided on the inner peripheral surface of the ring cam for being driven by the drive means to rotate the ring cam about the cam axis at a cam speed different than the drive speed.

According to one facet of the invention, the drive means is in the form of a drive gear and the driven means is in the form of an internal gear.

According to another facet of the invention, the drive gear is on the power shaft and rotates at the power shaft speed.

According to vet another facet of the invention, the drive gear and the internal gear are in mesh with one another.

According to one facet of the invention, the body of the ring cam is unitary with the cam surface and the internal gear is formed thereon.

According to another facet of the invention, the valve arrangement has plural valves and the cam surface has a plurality of axially-spaced lobes, each lobe actuating a valve as the ring cam is rotated about the cam axis.

According to yet another facet of the invention, a plain sleeve bearing is provided on the inner peripheral surface for rotatably mounting the ring cam to a stationary journal on the engine block for rotation about the cam axis.

According to one facet of the invention, the cam device further comprises first and second box-shaped cam followers for following the cam surface. An elongated aperture having a non-circular cross-section is formed in the engine for receiving the first and second cam followers and for guiding the first and second cam followers for sliding, linear motion relative to the engine block. The first and second cam followers are received in the aperture, bearing against each other for sliding, linear motion relative to each other and to the engine block, and have a combined cross-sectional shape that conforms to the non-circular cross-section of the aperture.

In another preferred embodiment, the invention is incorporated in an internal combustion engine having an engine block, a power shaft mounted in the engine block for rotation about a power shaft axis, a combustion chamber, a valve arrangement for controlling intake to and exhaust from the combustion chamber, and a cam device for actuating the valve arrangement. The cam device includes a ring cam having a unitary, generally ring-shaped body formed from powdered metal, with the body having an inner peripheral surface and an outer peripheral surface. The ring cam is mounted to the engine block for rotation about a cam axis displaced form the power shaft axis. A cam surface is formed on the outer peripheral surface of the body for actuating the valve arrangement as the ring cam is rotated about the cam axis. A drive gear is associated with the power shaft and nested inside the inner peripheral surface of the ring cam for driving the ring cam. The drive gear rotates at a drive speed and meshes with an internal gear formed on the inner peripheral surface of the ring cam. The ring cam may thus be driven by the drive gear to rotate the ring cam about the cam axis at a cam speed slower than the drive speed.

According to one facet of the invention the valve arrangement has multiple valves and the surface has a plurality of axially-spaced lobes for actuating the multiple valves as the ring cam is rotated about the cam axis.

In yet another preferred embodiment, the invention is incorporated in an internal combustion engine having an engine block, a power shaft mounted in the engine block for rotation about a power shaft axis, a combustion chamber, a valve arrangement for controlling the intake to and exhaust from the combustion chamber, and a cam device for actuating the value arrangement. The cam device includes a ring cam having a generally ring-shaped body, with the body having an inner peripheral surface and an outer peripheral surface. A sleeve bearing is provided on the inner peripheral surface for rotatably mounting the ring cam to a stationary journal on the engine block for rotation about a cam axis. A cam surface is provided on the outer peripheral surface of the body for actuating the valve arrangement as the ring cam is rotated about the cam axis. A drive means is operably engaged with the power shaft and nested inside the inner peripheral surface of the ring cam for driving the ring cam. The drive means rotates at a drive speed. A driven means is provided on the inner peripheral surface for being driven by the drive means to rotate the ring cam about the cam axis at a cam speed different than the drive speed.

According to one facet of the invention, the driven means is axially spaced from the sleeve bearing.

According to another facet of the invention, the body of the ring cam has first and second axially-spaced faces for axially locating the ring cam within the engine block. The first face has first plain bearing surface for reacting axial loads against the engine block, and the second face has a second plain bearing surface for reacting the axial loads against the engine block. The sleeve bearing, the driven means, and the cam surfaces are axially located between the first face and the second face.

In one preferred embodiment, the invention is incorporated in an internal combustion engine having an engine block, a combustion chamber, a valve arrangement for controlling intake to and exhaust from the combustion chamber, and a cam device for actuating the valve arrangement. The cam device includes a cam for generating the cam motion, a first cam follower for translating the cam motion into linear motion, a second cam follower for translating the cam motion into linear motion, and an elongated aperture having a non-circular cross-section formed in the engine for receiving the first and second followers and for guiding the first and second cam followers for sliding, linear motion relative to the engine block. The first and second cam followers are received in the aperture, bearing against each other for sliding, linear motion relative to each other and to the engine block and having a combined cross-sectional shape that conforms to the non-circular cross-section of the aperture.

According to one facet of the invention, the aperture has a rectangular cross section.

According to another facet of the invention, the aperture has three sides which are defined by a U-shaped channel in the engine block, and a fourth side which is defined by a cover mounted to the engine block.

According to another facet of the invention, the first and second cam followers have rectangular cross sections.

According to yet another facet of the invention, the first and second cam followers are formed from powdered metal.

Other objects and advantages will become apparent from the following specification taken in conjunction with the accompanying drawings.

DESCRIPTION OF THE PREFERRED EMBODIMENT

Figure 1:
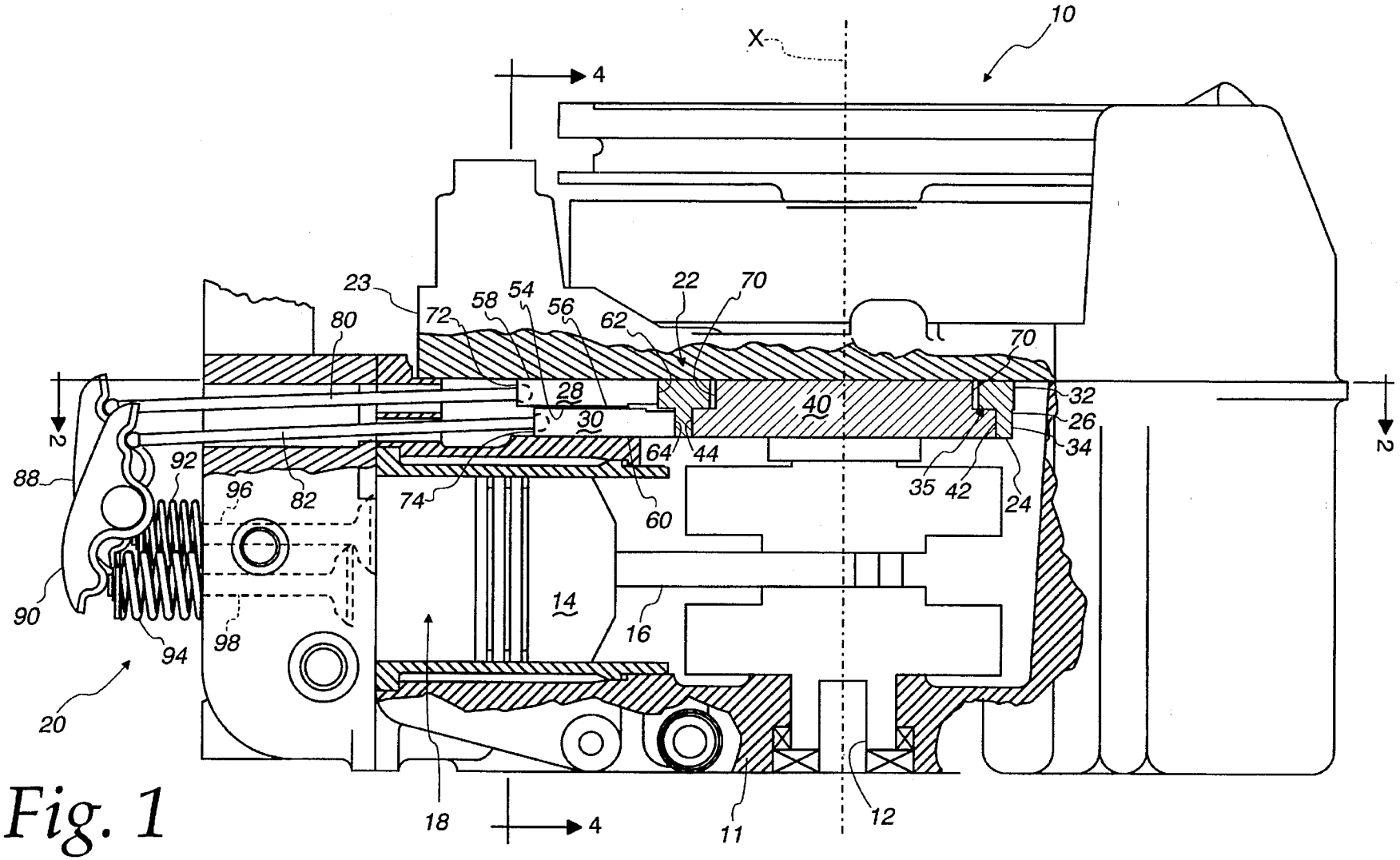
FIG. 1 is a side elevational view partially in section of an engine having a cam device embodying the invention.

An exemplary embodiment of a cam device made according to the invention is described herein and is illustrated in the drawings in connection with a valve arrangement in a single cylinder, four stroke, internal combustion engine. However, it should be understood that the invention may find utility in other applications, and that no limitations to use as a cam device for operation of a valve arrangement in a single cylinder, four stroke, internal combustion engine is intended except insofar as expressly stated in the appended claims.

With reference to FIG. 1, an internal combustion engine is fragmentarily shown at 10 and includes an engine block 11 containing a crankshaft/power shaft 12 which is rotationally driven by a piston 14 through a connecting rod 16 when fuel is combusted in the combustion chamber 18. A valve arrangement 20 controls the intake of fuel into the combustion chamber 18 and the exhaust of combustion products from the combustion chamber 18. The valve arrangement 20 is actuated by a cam device 22 which times the opening and closing of the valve arrangement 20 with respect to the position of the piston 14 and the power shaft 12. An engine block cover 23 encloses the engine components within the engine block 11.

Figure 2:
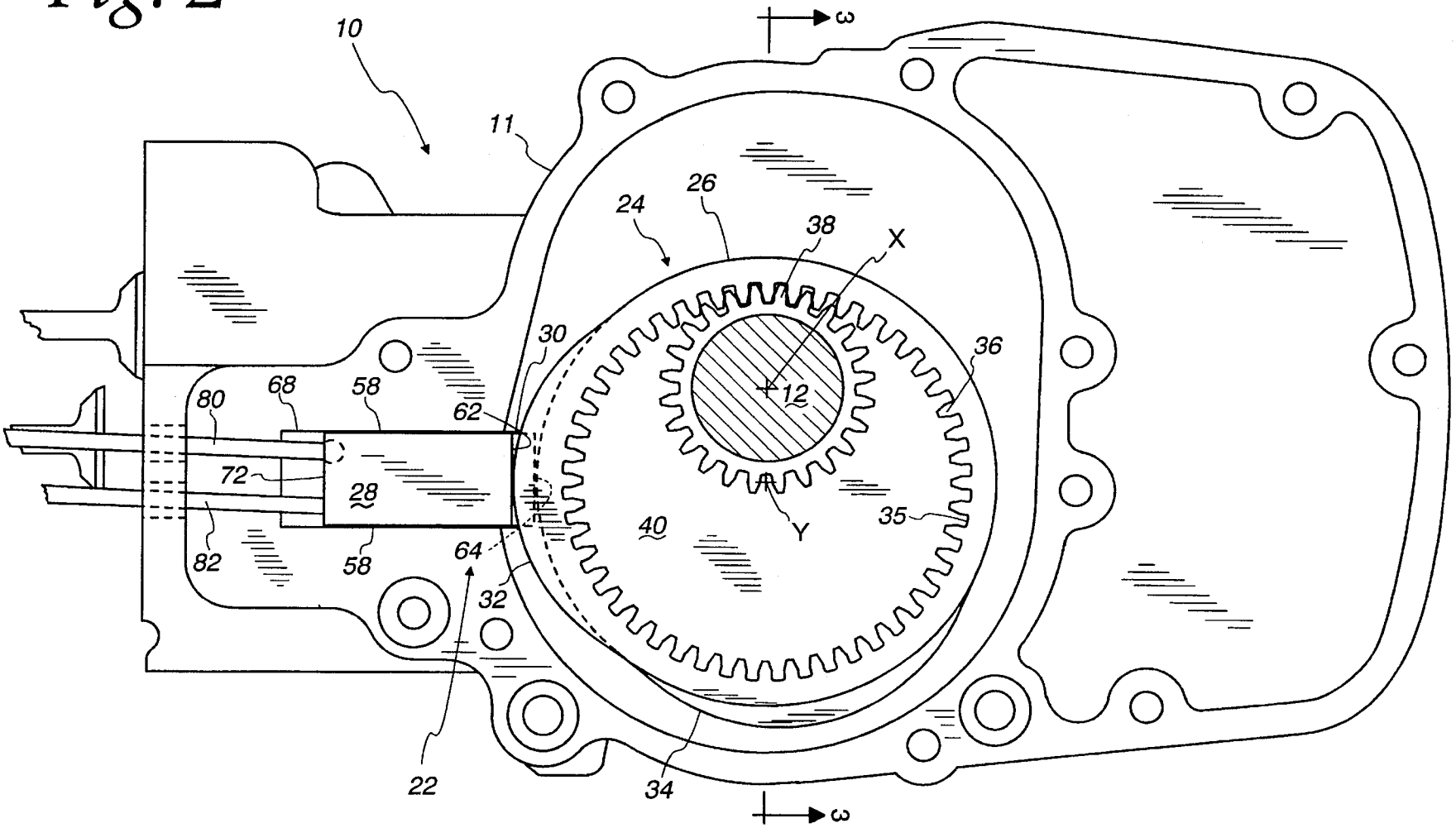
FIG. 2 is a sectional view of the engine taken substantially along the line 2—2 of FIG. 1.

The cam device 22 includes a ring cam 24 having a radially outer cam-shaped peripheral surface 26 which drives a pair of cam followers 28 and 30 for actuating the valve arrangement 20. The cam-shaped peripheral surface 26 of the ring cam 24 includes two axially-spaced lobes 32 and 34, with the upper lobe 32 being provided to drive the cam follower 28 and the lower lobe 34 being provided to drive the cam follower 30. The ring cam 24 further includes an inner peripheral surface 35. As best seen in FIG. 2, part of the inner peripheral surface 35 is configured as a ring gear 36 which is meshed with and driven by a drive gear 38 nested within the inner peripheral surface 35. The drive gear 38, preferably but not necessarily, is mounted on and fixed to the power shaft 12 so that it will rotate therewith.

The pitch diameter of the drive gear 38 is one-half the pitch diameter of the ring gear 36, thereby producing one revolution of the ring cam 24 for every two revolutions of the power shaft 12. Thus, the lobes 32 and 34 of the ring cam 24 actuate the valve arrangement 20 once for intake and once for exhaust for every two revolutions of the power shaft 12 and every four strokes of the piston 14. This relationship is appropriate for a four-cycle engine. The cam lobe 32 is angularly spaced from cam lobe 34 by approximately 105° to provide for the proper timing of the opening and closing of the intake and exhaust valves, as is well known.

As best seen in FIG. 2, one specific advantage of the disclosed cam device 22 is that it provides a relatively large average cam diameter in a relatively compact configuration. The large average cam diameter assures that the contact stress of the cam followers 28 and 30 on the surfaces of the cam lobes 32 and 34 will be relatively small when compared to standard engine cams. This is due in part to a consistently large instantaneous radius of curvature of the cam lobes 32 and 34 at the contact point with the cam followers 28 and 30, and in part to the long, smoothly transitioned cam surfaces provided by the relatively large average cam diameter. The lesser stress serves to increase the reliability and service life of the cam device 22 and allows for the ring cam 24 to be manufactured from powdered metal, with no finish grinding of the cam lobes 32 and 34.

Figure 3:
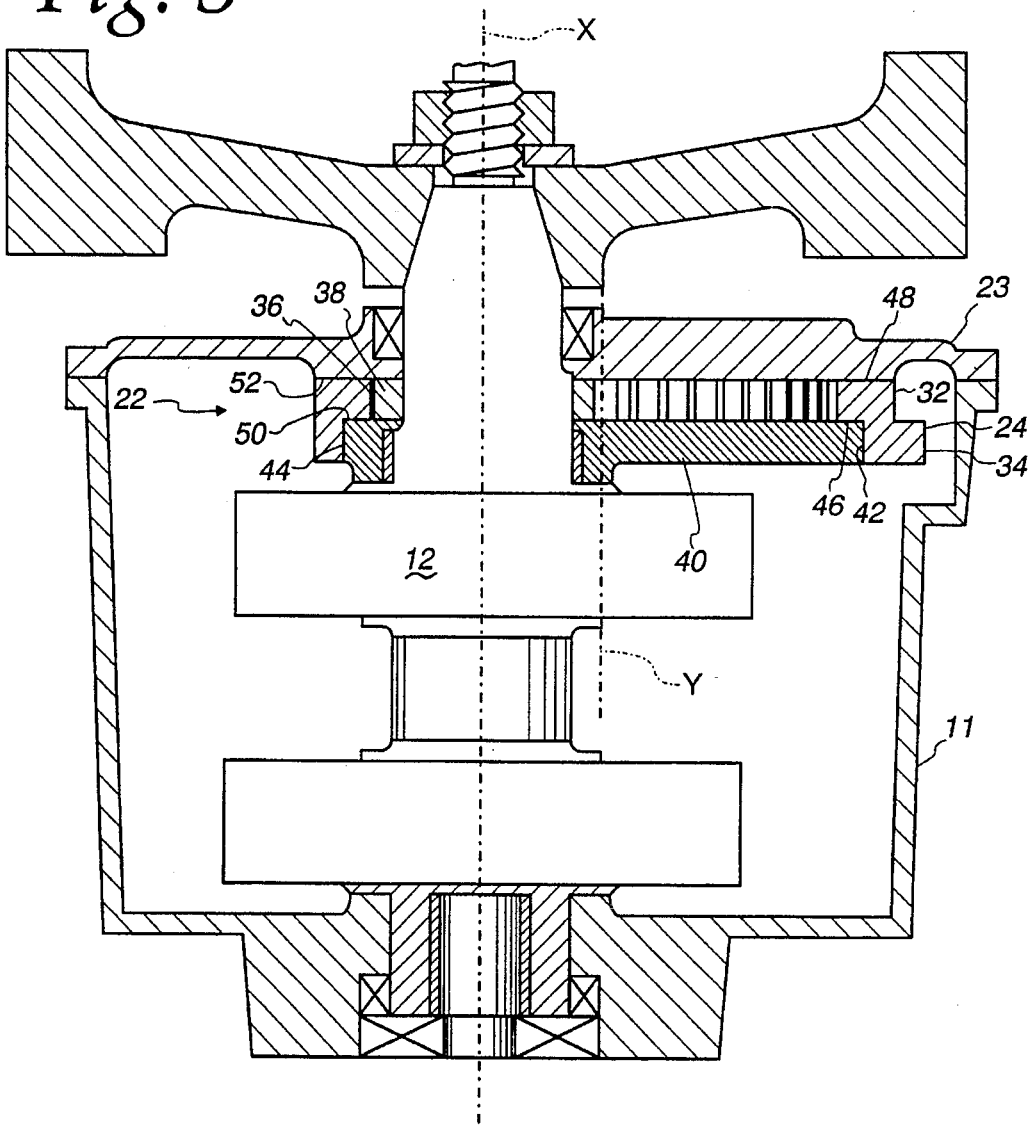
FIG. 3 is a sectional view of the engine taken substantially along the line 3—3 of FIG. 2.

As best seen in FIG. 3, the ring cam 24 is journaled for rotation about a cam axis Y on a bearing housing 40 which also journals the power shaft 12 for rotation about a power shaft axis X. More specifically, a plain sleeve bearing 42 is provided on the inner peripheral surface 35 of the ring cam 24 for rotatable mounting the ring cam 24 to a journal surface 44 on the bearing housing 40. Further, axially-spaced plain bearing thrust surfaces 46 and 48 are provided on the ring cam 24 to react axial loads against plain bearing thrust surfaces 50 and 52 on the bearing housing 40 and the engine block cover 23, respectively.

It should be noted that as shown in FIGS. 2 and 3, the cam axis Y is offset from the power shaft axis X. This offset configuration provides at least two specific advantages. First, the offset provides space within the inner peripheral surface 35 of the ring cam 24 which can be utilized for other engine components, thereby directly improving engine compactness and portability. A specific example of such an incorporation of other engine components is disclosed in commonly assigned, co-pending application of Eric B. Hudson, Ser. No. 08/472,892, filed Jun. 7, 1995, entitled RING GEAR PUMPS. Second, as best seen in FIG. 4, the offset provides a more compact packaging of the cam followers 28 and 30 within the engine 10 by allowing the cam followers 28 and 30 to be positioned relative to the cylinder 19 with an adequate amount of wall thickness in the engine block 11 while adding a minimum amount to the height of the engine 10.

Figure 4:
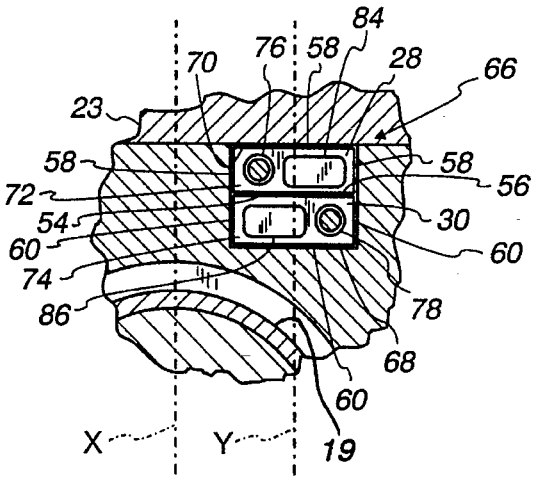
FIG. 4 is a partial sectional view of the engine taken substantially along lines 4—4 of FIG. 1.

As best seen in FIGS. 1 and 4, the cam followers 28 and 30 have mating surfaces 54 and 56, respectively, which bear against each other for sliding, linear motion relative to each other. The cam followers 28 and 30 are further provided with surfaces 58 and 60, respectively, which bear against the engine block 11 and the engine block cover 23 for sliding, linear motion relative to the engine block 11 and the engine block cover 23. As best seen in FIGS. 1 and 2, the cam followers 28 and 30 are provided with surfaces 62 and 64, respectively, which bear against the cam lobes 32 and 34, respectively, for following the cam profile of the cam lobes 32 and 34.

As best seen in FIGS. 2 and 4, the cam followers 28 and 30 are received in an elongated, non-circular aperture 66 formed in the engine 10. The non-circularity of the aperture 66 and the cam followers 28 and 30 prevents the cam followers 28 and 30 from rotating relative to the engine 10. The aperture 66 is defined by a U-shaped channel 68 formed in the engine block 11 and a surface 70 on the engine block cover 23. Thus, surfaces 58 and 60 of the cam followers 28 and 30 bear against and are guided by the U-shaped channel 68 in the surface 70 for sliding, linear motion relative to the engine block 11.

It will be appreciated that, while the illustrated embodiment discloses the cam followers 28 and 30 and the aperture 66 as being non-circular, the ring cam 24 is capable of actuating any common type of cam follower, including semi-circular cam followers received in a circular aperture.

As best seen in FIGS. 1 and 4, the cam followers 28 and 30 are provided with ends 72 and 74, respectively, having spherical apertures 76 and 78, respectively, for receiving the spherical shaped ends of push rods 80 and 82, respectively. The ends 72 and 74 are also provided with elongated apertures 84 and 86, respectively, which are formed in the cam followers 28 and 30 to reduce the inertial mass thereof, thereby reducing the forces required to drive the cam followers 28 and 30.

The valve arrangement 20 includes the push rods 80 and 82, rocking arms 88 and 90, valve springs 92 and 94, and valve stems 96 and 98. The valve springs 92 and 94 operate to pre-load the valve arrangement 20 by forcing the valve stems 96 and 98, respectively, against one end of a corresponding one of the rocking arms 88 and 90, respectively, which forces the other end of the respective rocking arm 98 and 90 against the push rods 80 and 82, respectively, which then transfer the force of the valve springs 92 and 94 to the cam followers 28 and 30, respectively, thereby forcing the cam followers 28 and 30 against the cam lobes 32 and 34. In operation, the cam lobes 32 and 34 actuate the cam followers 28 and 30 for sliding, linear motion within the non-circular aperture 66. The motion of the cam followers 28 and 30 is transferred to the valve stems 96 and 98 through the push rods 80 and 82 which actuate the rocking arms 88 and 90 against the force of the valve springs 92 and 94.

As best seen In FIG. 4, one advantage of the rectangular cross-section of the cam followers 28 and 30 is that it adds additional flexibility in the packaging of the valve arrangement 20 by allowing for the push rods 80 and 82 to be spaced relatively far apart without requiring an overall increase in the combined height of the cam followers 28 and 30 or in the height of the engine.

Accordingly, a cam device 22 has been provided which lends itself to compact engine design while providing a high reliability for the engine and increased portability of the engine. The ring cam 24 of the cam device 22 is driven by the power shaft 12 through the drive gear 38 and a ring gear 36 formed on the inner peripheral surface 35 of the ring cam 24. The cam lobes 32 and 34 formed on the peripheral surface 26 of the ring cam 24 actuate the cam followers 28 and 30 for sliding, linear motion within the non-circular aperture 66 formed in the engine 10.

What is claimed is:

1. In an internal combustion engine including an engine block, a power shaft mounted in the engine block for rotation about a power shaft axis, a combustion chamber, a valve arrangement for controlling intake to and exhaust from the combustion chamber, and a cam device for actuating the valve arrangement; the improvement wherein said cam device comprises:

a ring cam having a generally ring shaped body, the body having an inner peripheral surface and an outer peripheral surface, the ring cam being mounted to the engine block for rotation about a cam axis displaced from the power shaft axis;

a cam surface on the outer peripheral surface of the body for actuating the valve arrangement as the ring cam is rotated about the cam axis;

drive means operably engaged with the power shaft and nested inside the inner peripheral surface of the ring cam for driving the ring cam, the drive means rotating at a drive speed; and driven means on the inner peripheral surface of the ring cam for being driven by the drive means to rotate the ring cam about the cam axis at a cam speed different than the drive speed.

2. The improvement of claim 1 wherein the drive means is in the form of a drive gear, and the driven means is in the form of an internal gear.

3. The improvement of claim 2 wherein the drive gear is on the power shaft and rotates at the power shaft speed.

4. The improvement of claim 2 wherein the drive gear and the internal gear are in mesh.

5. The improvement of claim 1 wherein the body is unitary with the cam surface and the driven means being formed thereon.

6. The improvement of claim 1 wherein the valve arrangement has plural valves and the cam surface has a plurality of axially spaced lobes, each lobe actuating a valve as the ring cam is rotated about the cam axis.

7. The improvement of claim 1 further comprising a plain sleeve bearing on the inner peripheral surface for rotatable mounting the ring cam to a stationary journal on the engine block for rotation about the cam axis.

8. The improvement of claim 1 further comprising:

a first box-shaped cam follower for following the cam surface;

a second box-shaped cam follower for following the cam surface;

an elongated aperture having a non-circular cross-section formed in the engine for receiving the first and second cam followers and for guiding the first and second cam followers for sliding, linear motion relative to the engine block; and the first and second cam followers being received in the aperture, bearing against each other for sliding, linear motion relative to each other and to the engine block, and having a combined cross-sectional shape that conforms to the non-circular cross-section of the aperture.

9. In an internal combustion engine including an engine block, a power shaft mounted in the engine block for rotation about a power shaft axis, a combustion chamber, a valve arrangement for controlling intake to and exhaust from the combustion chamber, and a cam device for actuating the valve arrangement; the improvement wherein said cam device comprises:

a ring cam having a unitary, generally ring shaped body formed from powdered metal, the body having an inner peripheral surface and an outer peripheral surface, the ring cam being mounted to the engine block for rotation about a cam axis displaced from the power shaft axis;

a cam surface formed on the outer peripheral surface of the body for actuating the valve arrangement as the ring cam is rotated about the cam axis;

a drive gear associated with said power shaft nested inside the inner peripheral surface of the ring cam for driving the ring cam;

the drive gear rotating at a drive speed; and an internal gear formed on the inner peripheral surface of the ring cam, the internal gear meshing with the drive gear and being driven by the drive gear to rotate the ring cam about the cam axis at a cam speed slower than the drive speed.

10. The improvement of claim 9 wherein the drive gear is on the power shaft and rotates at the power shaft speed.

11. The improvement of claim 9 wherein the valve arrangement has multiple valves and the cam surface has a plurality of axially spaced lobes for actuating the multiple valves as the ring cam is rotated about the cam axis.

12. The improvement of claim 9 further comprising a plain sleeve bearing on the inner peripheral surface for rotatable mounting the ring cam to a stationary journal on the engine block for rotation about the cam axis.

13. In an internal combustion engine including an engine block, a power shaft mounted in the engine block for rotation about a power shaft axis, a combustion chamber, a valve arrangement for controlling intake to and exhaust from the combustion chamber, and a cam device for actuating the valve arrangement; the improvement wherein said cam device comprises:

a ring cam having a generally ring shaped body, the body having an inner peripheral surface and an outer peripheral surface, a sleeve bearing on the inner peripheral surface for rotatable mounting the ring cam to a stationary journal on the engine block for rotation about a cam axis, a cam surface on the outer peripheral surface of the body for actuating the valve arrangement as the ring cam is rotated about the cam axis;

drive means operably engaged with the power shaft and nested inside the inner peripheral surface of the ring cam for driving the ring cam, the drive means rotating at a drive speed; and driven means on the inner peripheral surface of the ring cam for being driven by the drive means to rotate the ring cam about the cam axis at a cam speed different than the drive speed.

14. The improvement of claim 13 wherein the driven means is axially spaced from the sleeve bearing.

15. The improvement of claim 13 wherein the body of the ring cam has first face for axially locating the ring cam within the engine block.

16. The improvement of claim 15 wherein the first face has a first plain bearing surface for reacting axial loads against the engine block.

17. The improvement of claim 15 wherein the body of the ring cam has a second face, axially spaced from the first face, for further axially locating the ring cam within the engine block.

18. The improvement of claim 17 wherein the first face has a first plain bearing surface for reacting axial loads against the engine block, and the second face has a second plain bearing surface for reacting axial loads against the engine block.

19. The improvement of claim 17 wherein the sleeve bearing, the driven means, and the cam surface are axially located between the first face and the second face.

20. In an internal combustion engine including an engine block, a combustion chamber, a valve arrangement for controlling intake to and exhaust from the combustion chamber, and a cam device for actuating the valve arrangement; the improvement wherein said cam device comprises:

a cam for generating a cam motion, a first cam follower for translating the cam motion into linear motion;

a second cam follower for translating the cam motion into linear motion;

an elongated aperture having a non-circular cross-section formed in the engine for receiving the first and second cam followers and for guiding the first and second cam followers for sliding, linear motion relative to the engine block; and the first and second cam followers being received in the aperture, bearing against each other for sliding, linear motion relative to each other and to the engine block and having a combined cross-sectional shape that conforms to the non-circular cross-section of the aperture.

21. The improvement of claim 20 wherein the aperture has a rectangular cross-section.

22. The improvement of claim 21 wherein three sides of the aperture are defined by a U-shaped channel in the engine block and a fourth side of the aperture is defined by a cover mounted to the engine block.

23. The improvement of claim 21 wherein the first and second cam followers have rectangular cross-sections.

24. The improvement of claim 20 wherein the first and second cam followers are formed from powdered metal.

* * * * *